US007883091B1

(12) United States Patent
Wilds et al.

(10) Patent No.: US 7,883,091 B1
(45) Date of Patent: Feb. 8, 2011

(54) HORSE RACING BOARD GAME

(76) Inventors: John C. Wilds, 1602 Prehistoric Hill Dr., Imperial, MO (US) 63052; Margaret J. Wilds, 1602 Prehistoric Hill Dr., Imperial, MO (US) 63052

( * ) Notice: Subject to any disclaimer, the term of this patent is extended or adjusted under 35 U.S.C. 154(b) by 6 days.

(21) Appl. No.: 12/286,829

(22) Filed: Oct. 2, 2008

(51) Int. Cl.
*A63F 3/00* (2006.01)

(52) U.S. Cl. ..... 273/246; 273/243; 273/248

(58) Field of Classification Search ..... 273/246, 273/243, 248, 250, 251, 252, 253
See application file for complete search history.

(56) References Cited

U.S. PATENT DOCUMENTS

| | | | | | |
|---|---|---|---|---|---|
| 2,653,027 | A | | 9/1953 | Barash | |
| 2,727,746 | A | * | 12/1955 | Hawkes | 273/246 |
| 3,963,243 | A | | 6/1976 | Contento | |
| 4,060,246 | A | * | 11/1977 | Ward | 273/277 |
| 4,729,568 | A | * | 3/1988 | Welsh | 273/246 |
| 4,874,177 | A | | 10/1989 | Girardin | |
| 4,986,546 | A | * | 1/1991 | Cerulla | 273/240 |
| 5,048,841 | A | | 9/1991 | Manney et al. | |
| 5,226,655 | A | | 7/1993 | Rickabaugh | |
| 5,322,293 | A | * | 6/1994 | Goyette | 273/246 |
| 5,437,459 | A | * | 8/1995 | Kirby | 273/246 |
| 5,551,699 | A | * | 9/1996 | Pavelich | 273/246 |
| 5,823,872 | A | | 10/1998 | Prather et al. | |
| 5,853,173 | A | | 12/1998 | Murphy | |
| 6,095,522 | A | | 8/2000 | Spell et al. | |
| 7,025,353 | B2 | | 4/2006 | Lydick | |
| 2004/0222589 | A1 | * | 11/2004 | Taylor | 273/246 |

* cited by examiner

*Primary Examiner*—Vishu K. Mendiratta
(74) *Attorney, Agent, or Firm*—Kevin L. Klug

(57) ABSTRACT

A horse racing board game which allows a global movement of all game pieces by all players yet provides a substantially equal probability of any game piece reaching the finish line and one or more players winning all or a portion of game currency within a game pot. The game has an amount of positions between a start and finish within each lane which are substantially proportional to the single event probability of a random number generator generating the number of the lane in which the positions are located. The random number generator is a pair of conventional dice or any other random number generator each of which have a probability distribution which said amount of positions are substantially proportional to.

6 Claims, 7 Drawing Sheets

1st horse goes in the 1 dollar 1st square

2nd horse goes in the 2 dollar 2nd square

3rd horse goes in the 3 dollar 3rd square

4th horse goes in the 4 dollar 4th square

See diagram on the right.

| | 1st | 2nd | 3rd | 4th |
|---|---|---|---|---|
| 1 Dollar | 2 | | | |
| 2 Dollars | | 4 | | |
| 3 Dollars | | | 6 | |
| 4 Dollars | | | | 8 |

Cards correspond with horse number

Fig. 4

HORSE RACING BOARD GAME

BACKGROUND OF THE INVENTION

The art of the present invention relates to board games in general and more particularly to a horse racing board game having a track with a plurality of numbered lanes in which each lane is divided into positions, spaces, or segments. For the preferred embodiment, the number of positions, spaces, or segments per lane is substantially proportional to the relative probability of a pair of conventional dice rolling the lane number on a single roll.

It is recognized within and during the play of games which utilize a pair of dice that the minimum value which may be rolled per pair is 2 (i.e. two ones) and the maximum value which may be rolled is twelve (i.e. two sixes). It is also recognized that the probability of rolling a seven on a single roll of two dice is greater than that of any other value. For a value of two or of 12 to occur during a single roll, the probability is easily calculated as:

$$\frac{1}{6}\cdot\frac{1}{6}=\frac{1}{36}$$

That is, since each dice is six sided and two ones or two sixes must be rolled at the same time respectively, the total probability is the product of each single value dice probability. When calculating the probability of other values occurring, the permutations and combinations of such occurrence must be contemplated prior to calculation of the probability. For example, the probability of rolling a seven value is the summation of the probabilities of rolling the combination of a one-six, a two-five, a three-four, a four-three, a five-two, and a six-one. Each of the corresponding individual values represents a probability of 1/36 and when summed represent:

$$\frac{1}{6}+\frac{1}{6}+\frac{1}{6}+\frac{1}{6}+\frac{1}{6}+\frac{1}{6}=\frac{6}{36}=\frac{1}{6}$$

So while the probability of rolling a two or a 12 value is 1/36, the probability of rolling a seven is much greater at 1/6. When calculated for all values which may be rolled from a pair of dice, the following table represents the respective probabilities:

| Value | 2 | 3 | 4 | 5 | 6 | 7 | 8 | 9 | 10 | 11 | 12 |
|---|---|---|---|---|---|---|---|---|---|---|---|
| Probability | 1/36 | 2/36 | 3/36 | 4/36 | 5/36 | 6/36 | 5/36 | 4/36 | 3/36 | 2/36 | 1/36 |

Thus, if movement of a game piece is dependent upon the lane number which a pair of dice rolls, the number of spaces or segments for each lane must represent the probabilities of rolling that lane number in order to provide a substantially equal chance of each game piece in each lane crossing the finish line. If each lane had the same number of spaces or segments and every time the lane number was rolled with a pair of dice, the game piece in that lane advanced one space, lane seven would most likely win every game. In order to make the probabilities of each lane winning approximately equal with the other lanes, the number of spaces per lane must substantially satisfy the following equation:

$$\text{(number of spaces per lane for X)} = n\cdot 36\cdot\text{(probability of rolling the lane number X with a single roll of a pair of dice)}$$

Where "n" is an integer value greater than zero. If the aforesaid equation is not satisfied for each lane, one or more lanes will have an advantage or disadvantage relative to the other lanes.

Prior art board games and horse racing board games in particular which utilize a pair of dice for game piece movement have failed to account for the aforesaid. That is, they generally treat a roll of a pair of dice as a random number generator. From the aforesaid, it is clear that the value rolled from a pair of dice is not a uniform probabilistic distribution. This phenomena forces each player to roll the dice for each lane rather than the game as a whole. This prior art technique of play is further described in U.S. Pat. No. 5,226,655, entitled Apparatus and Method of Playing a Board Game Simulating Horse Racing and Wagering issued to Rickabaugh on Jul. 13$^{th}$, 1993.

In its preferred embodiment, the present art comprises a game board having eleven lanes numbered two through 12 and a holding stable for game pieces (preferably in the form of horses) corresponding to lanes which are not utilized within the game. The game pieces corresponding to the lane numbers which are not utilized are placed within the holding stable substantially adjacent to a currency amount which must be paid into a central game pot if a player rolls a value corresponding to the lane number of a game piece not running the race. In its preferred embodiment, the present art utilizes a pair of dice which, when rolled, allow the players to move the game piece in the lane corresponding to the value which occurs due to the dice roll yet graduates the number or amount of spaces or positions per numbered lane in order to substantially equalize the probabilities of any game piece crossing the finish line. For the preferred embodiment, the number of spaces or positions for each lane prior to the finish line is:

| Lane Number | 2 | 3 | 4 | 5 | 6 | 7 | 8 | 9 | 10 | 11 | 12 |
|---|---|---|---|---|---|---|---|---|---|---|---|
| Number of spaces or positions | 2 | 4 | 6 | 8 | 10 | 12 | 10 | 8 | 6 | 4 | 2 |

For the preferred embodiment, probabilistically, the total number of spaces or segments per lane prior to the finish line is an integer number which substantially represents the theoretical number of times the lane number would occur (i.e. be rolled by the dice) if a pair of dice were rolled 72 times. The preferred embodiment of the present art game has a fiat game currency denominated as 1, 2, 3, 5, & 10 which is used during game play. A set of playing cards numbered two through 12 which correspond to the relative lane numbers are randomly distributed to the players with the exception of the card values retained within the holding stable. The players holding the card numbers corresponding to the lane number in which a game piece first crosses the finish line divide and retain the game currency within the pot.

Accordingly, it is an object of the present invention to provide a horse racing board game which allows each player to hold numbered cards which collectively represent the player's proportional stake of the pot for the game piece horse within the lane which crosses the finish line first.

Another object of the present invention is to provide a horse racing board game utilizing the random nature of a dice roll for all game piece movement yet giving each player holding a stake in any particular lane number a substantially equal chance of winning the game currency within a central game pot.

A further object of the present invention is to provide a horse racing board game having a plurality of numbered lanes corresponding to the values which can occur from a single roll of a pair of dice.

A yet further object of the present invention is to provide a horse racing board game having a number of spaces or segments per numbered lane which substantially equalizes the probability that any player holding cards of any numbered lane will win a stake in the game pot upon final crossing of the finish line by any game piece.

A still further object of the present invention is to provide a horse racing board game which allows each player to have a stake in the game as a whole rather than any individual game piece.

SUMMARY OF THE INVENTION

In accordance with the present invention, the preferred embodiment represents a horse racing board game comprising a game board having eleven numbered lanes, a set of 44 enumerated players cards with four representative cards for each lane number, a set of fiat game currency denominated in values of 1, 2, 3, 5, and 10, a game piece for each lane which is shaded to a substantially equivalent color of the lane itself, and a pair of conventional dice. The aforesaid number of lanes, cards, currency values, game pieces, and dice are provided for enablement purposes only with alternative embodiments utilizing any number of the aforesaid, provided the probability of any game piece reaching or crossing the finish line in any lane remains substantially the same when based upon a global movement of the game pieces pursuant to one or more dice rolls.

For the preferred embodiment, the game board lanes each have a number of positions or spaces prior to the finish line which substantially correspond to the theoretical probability of rolling the specific lane number during 72 rolls of a pair of dice. That is, lane two has two positions, lane three has four positions, lane four has six positions, lane five has eight positions, lane six has 10 positions, lane seven has 12 positions, lane eight has 10 positions, lane nine has eight positions, lane 10 has six positions, lane 11 has four positions, and lane 12 has two positions, all of which are prior to the finish line. Alternative embodiments may utilize a plurality of positions or spaces provided the aforesaid weighted relationship between each lane is somewhat closely maintained.

The preferred embodiment of each game board has a holding stable which allows a predetermined (or player defined) number of game pieces to be removed from the game and further provide a means for feeding the game pot. Each game piece removed from the race is placed within a table space of said holding stable and depending upon the position therein is assigned a game currency value. If a player rolling the pair of dice rolls a lane number corresponding to a game piece held within the holding stable, the player must place an amount of currency corresponding to said assigned value within the game pot.

The numbered players cards are randomly distributed to the players and represent the stake each player has in the game pot. That is, the players having the numbered cards corresponding to the lane number in which the first game piece crosses the finish line share in the game pot proportionally with the number of cards held for said lane number.

Present art game play begins with a distribution of the game currency to the players. (recommended at 75 fiat dollars) One or more (preferably four) enumerated players cards are dealt face up from a randomly shuffled deck and represent game pieces from the corresponding lane numbers which are placed into the holding stable and which will not run the game race. Placement into the holding stable is according to the order in which the enumerated players cards are dealt and a fiat dollar value is assigned according to the table space layout of the holding stable. For the preferred embodiment, a one dollar value is assigned the first game piece, a two dollar value is assigned a second game piece, a three dollar value is assigned a third game piece, and a four dollar value is assigned a fourth game piece.

The remaining randomly shuffled enumerated cards are dealt equally to all the players and the game pieces within the game race are placed at the starting gate with each player also anteing an amount into the game pot (preferably one game dollar). Each player discards any cards corresponding to game pieces within the holding stable. The game begins with a first player rolling the pair of game dice. If a player rolls a value corresponding to a game piece from a lane within the holding stable, he/she pays an amount corresponding to the table space value assigned. If the player rolls a lane number for which a game piece horse is running, he/she moves the game piece in that lane one position or space. The pair of dice then are given to the next player and repeats in order as aforesaid. When a game piece horse in a numbered lane eventually crosses the finish line, the game pot is distributed to the persons holding the cards for said numbered lane in proportion to the number of cards with that lane number which are held by players. That is, for the preferred embodiment, 25% of the pot is transferred for each enumerated card held with the winning lane number. Amounts which are not equally dividable between the winners remain within the game pot. That is, the pot amount is divided by four (for the preferred embodiment) with the quotient amount going to the winning players and the remainder remaining within the game pot for the next game.

The present art assembly may be manufactured from a plurality of materials including but not limited to papers, woods, plastics, metallic materials, composites, and/or implemented virtually via a computer and associated software. For the preferred embodiment, the game board is manufactured from a cardboard material, the player cards and game currency are manufactured from a paper material, and the game pieces in the form of running horses and the pair of dice are molded from a plastic material. Virtual implementation may be partial, i.e. via a random number generator creating the random number distribution desired or other portions of the game implemented via computer software, or the game may be fully implemented via software. This includes but is not limited to the implementation of sound effects such as galloping horses, finish line trumpets, cheering crowds, starting guns, and announcers.

BRIEF DESCRIPTION OF THE DRAWINGS

Numerous other objects, features, and advantages of the invention should now become apparent upon a reading of the following detailed description taken in conjunction with the accompanying drawings, in which:

FIG. 1 utilizes a photograph as the only practicable medium for illustrating the claimed invention as a whole pursuant to 37 CFR 1.84.

FIG. 4 is a view of the preferred embodiment of the holding stable with instructions on game piece placement.

DETAILED DESCRIPTION

Figure 1:
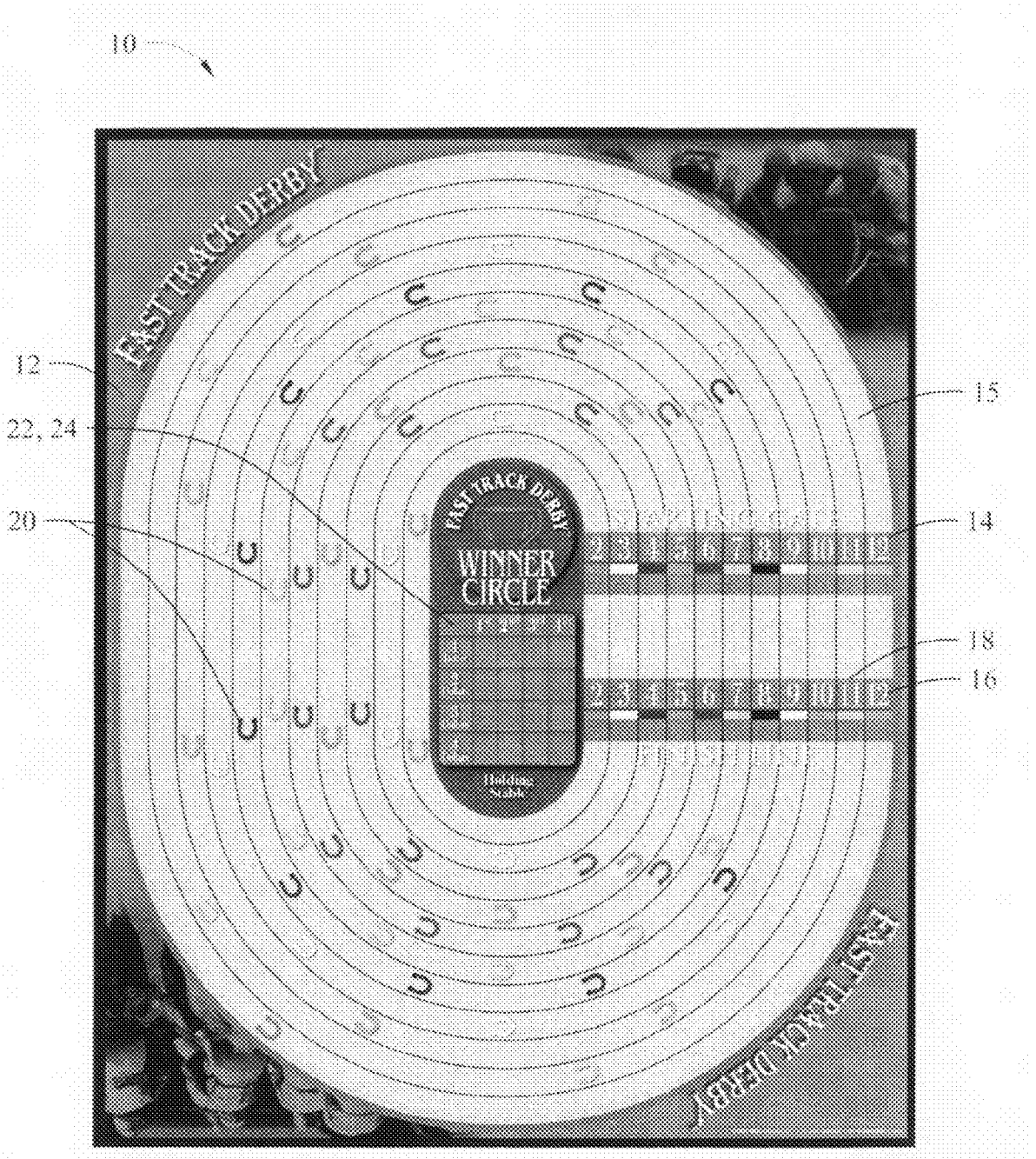
FIG. 1 is a top plan view of a preferred embodiment of the game board of the horse racing board game.
Figure 2A:
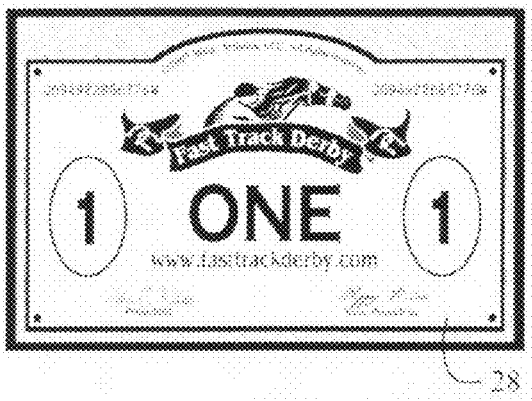
FIGS. 2A-2E are plan views of the preferred embodiment fiat game currencies.
Figure 2B:
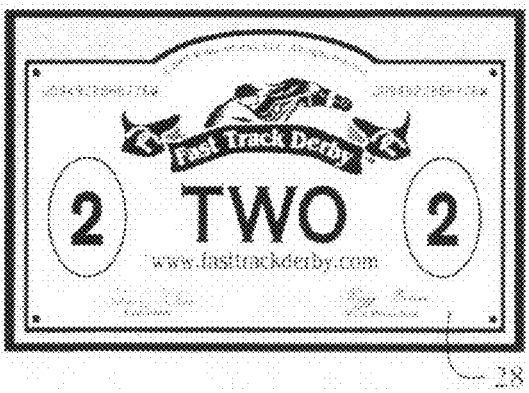
Figure 2C:
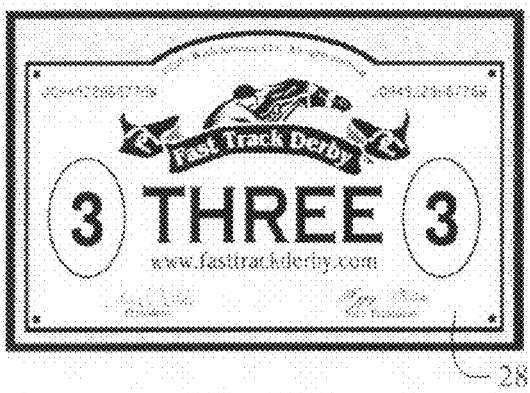
Figure 2D:
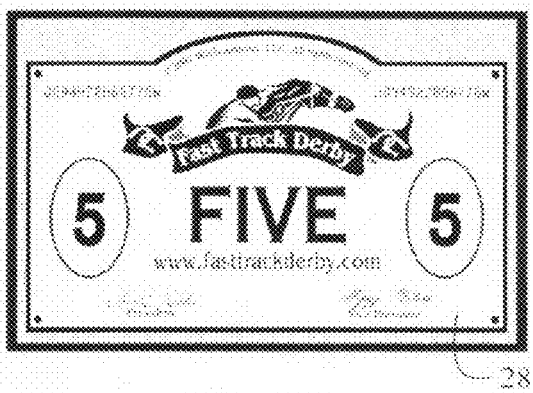
Figure 2E:
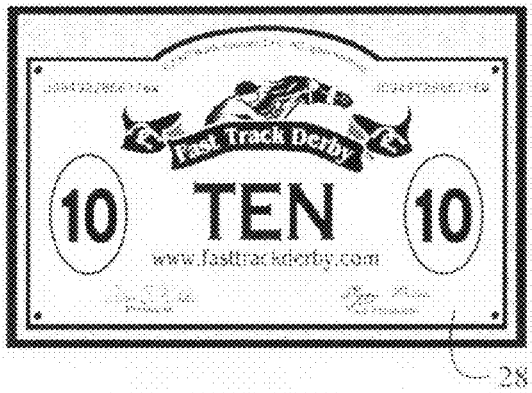
Figure 3A:
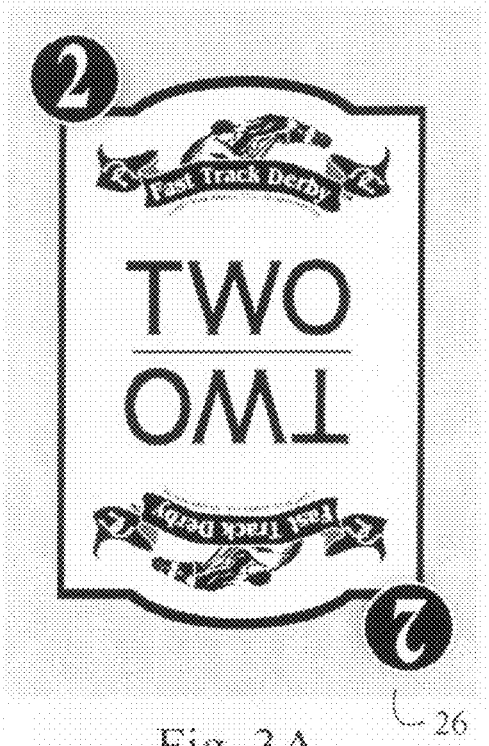
FIGS. 3A-3K are plan views of the preferred embodiment game cards.
Figure 3B:
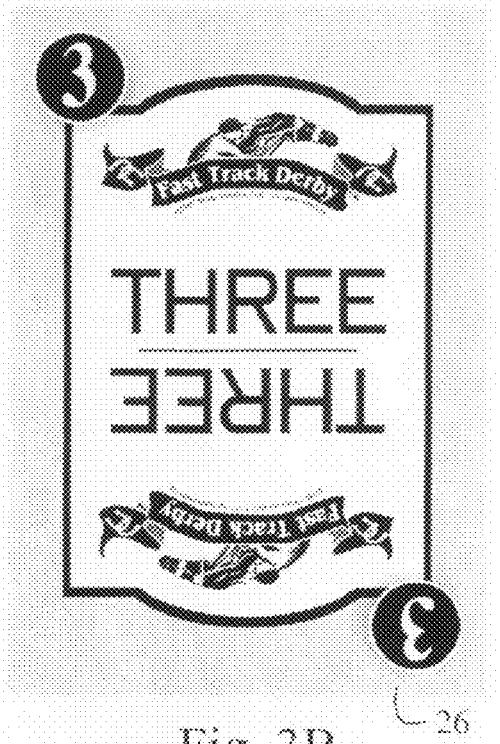
Figure 3C:
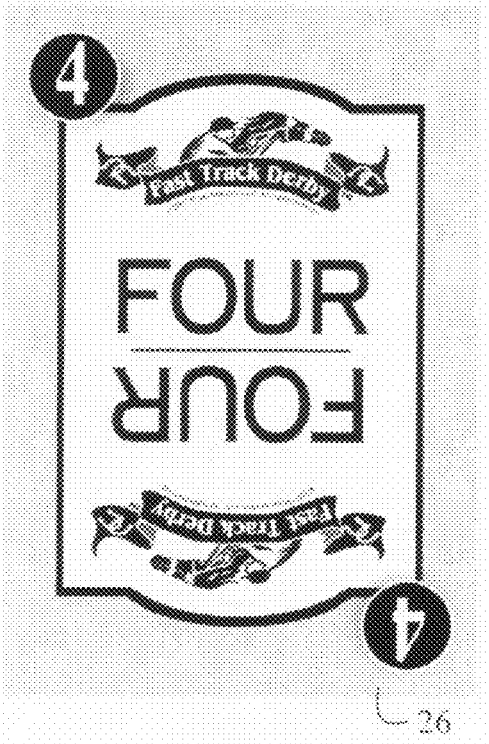
Figure 3D:
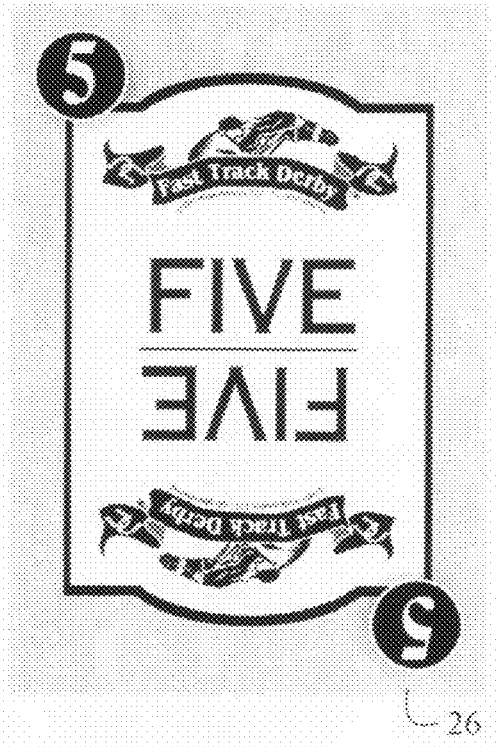
Figure 3E:
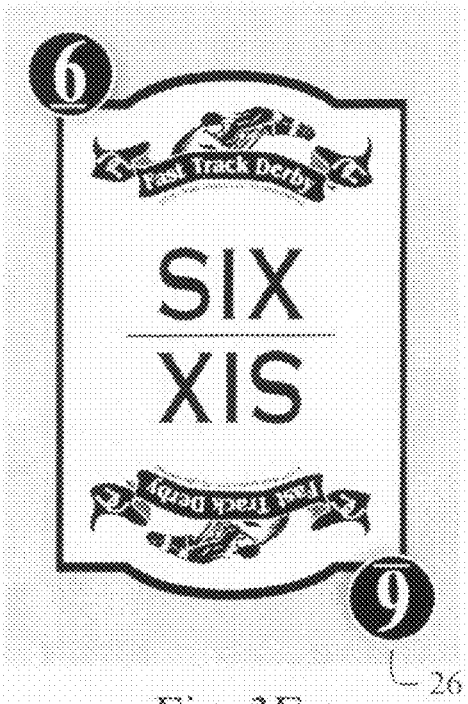
Figure 3F:
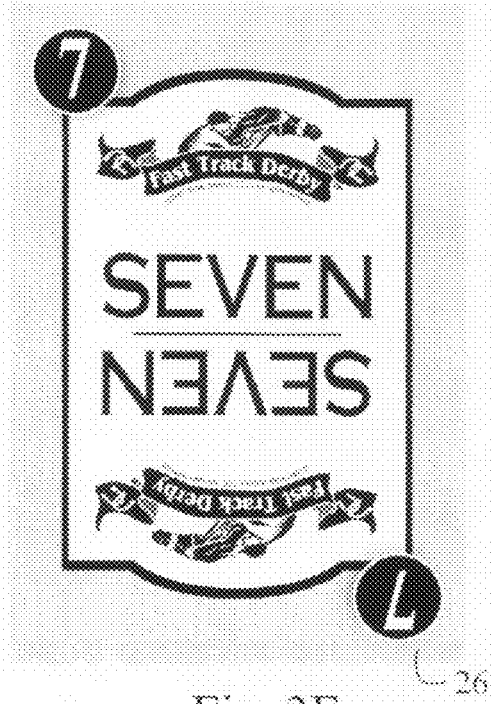
Figure 3G:
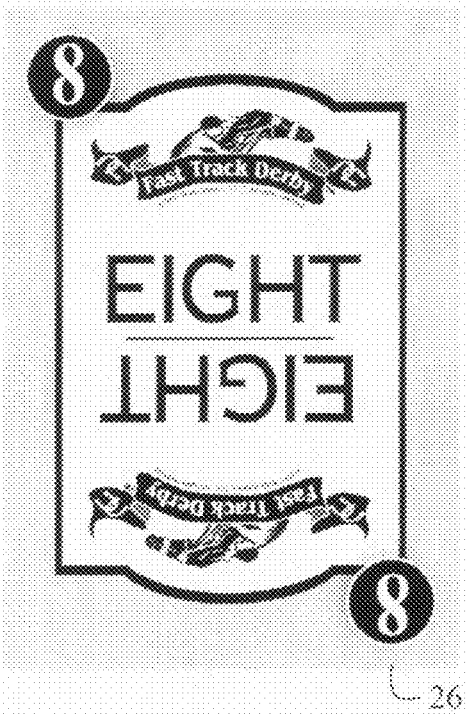
Figure 3H:
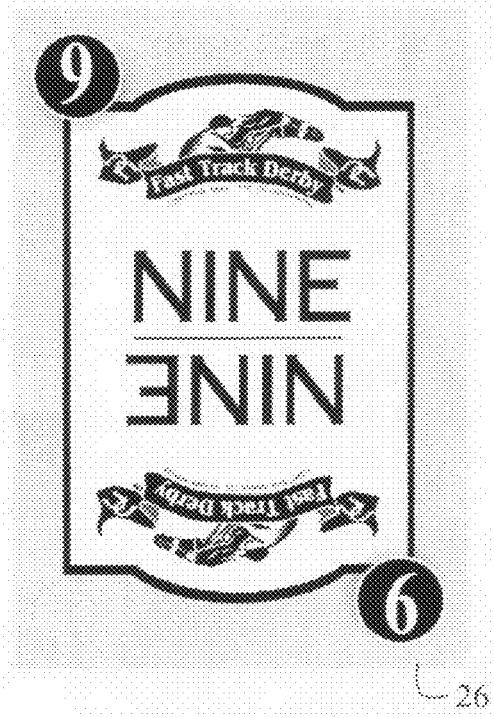
Figure 3I:
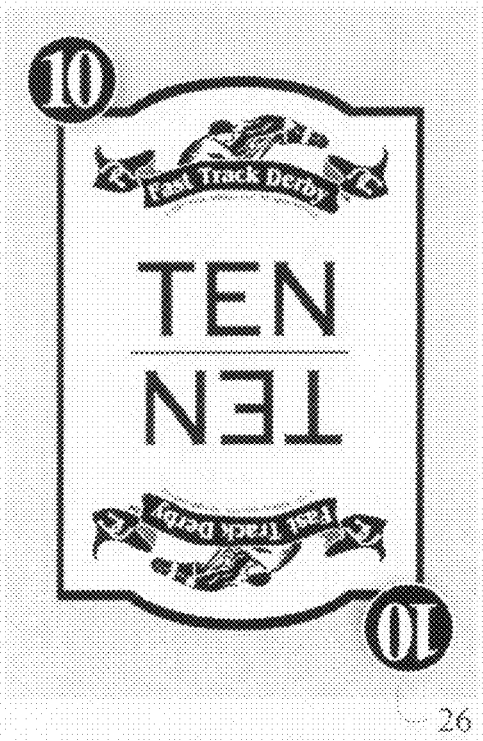
Figure 3J:
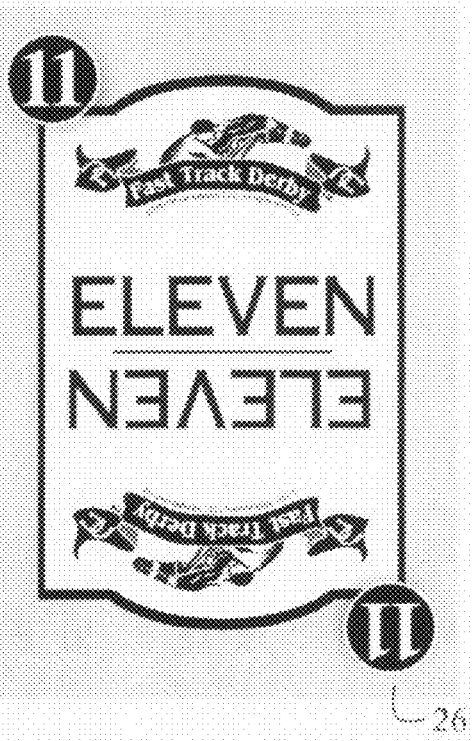
Figure 3K:
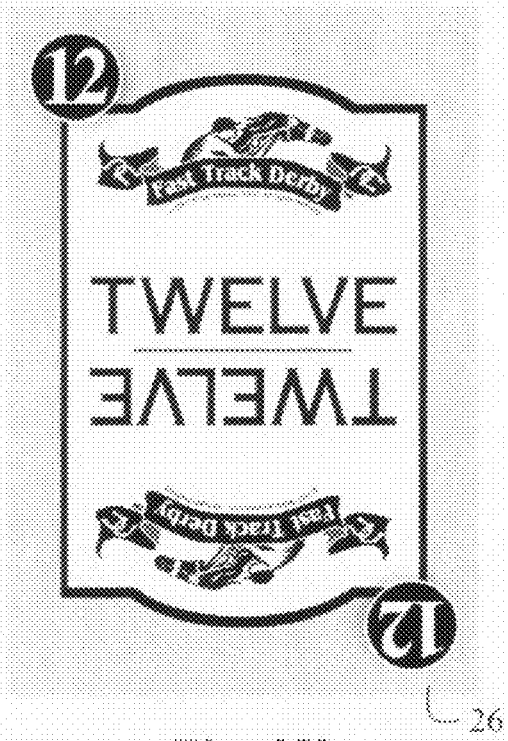
Figure 5A:
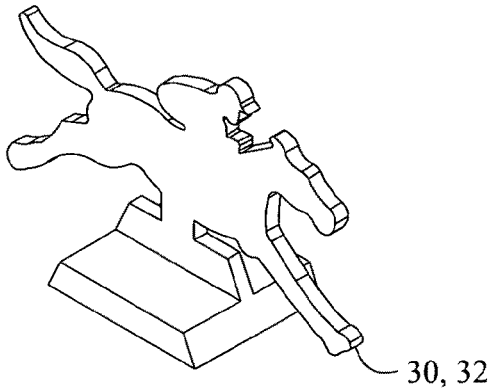
FIGS. 5A-5D are respectively a perspective, a side plan, a top plan, and a front plan view of the preferred embodiment game piece.
Figure 5B:
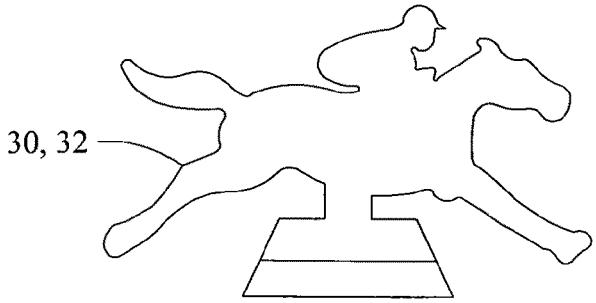
Figure 5C:
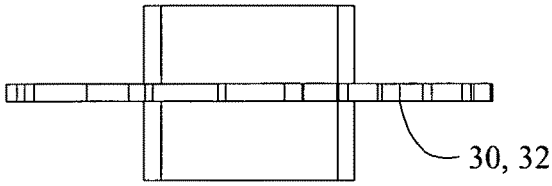
Figure 5D:
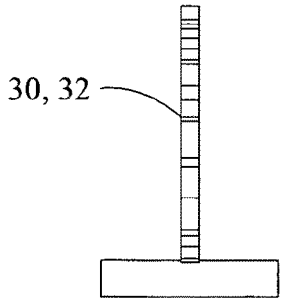
Figure 6:
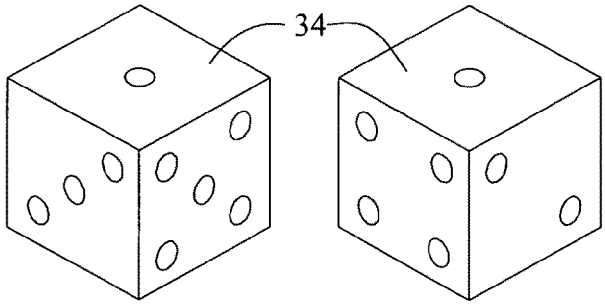
FIG. 6 is a perspective view of a conventional pair of dice as utilized with the preferred embodiment.

Referring now to the drawings, there is shown in FIGS. 1-6 a preferred embodiment of the horse racing board game 10. The game 10 is especially useful for players which desire a game based upon the roll of a pair of dice 34 whereby each game piece 30 has a substantially equal chance of crossing the finish line 16.

The board game 10 comprises a game board 12, a set of enumerated players cards 26, denominated values of game currency 28, game pieces 30 (in the shape of a running horse 32 in the preferred embodiment), and a conventional pair of dice 34. The game board 12 comprises a track 15, preferably in an oval form, having a starting gate 14 and a finish line 16. Between said starting gate 14 and finish line 16 is a plurality of numbered lanes 18, again preferably in an oval form. Each lane 18 has one or more (i.e. an amount) of positions or spaces 20 between said starting gate 14 and finish line 16. For the preferred embodiment, the number or amount of positions or spaces 20 per lane is dependent upon the lane 18 number and the theoretical probability of rolling said lane 18 number with a pair of conventional dice 34. That is, for a conventional pair of dice 34, the number or amount of positions or spaces 20 per lane 18 prior to the finish line for the preferred embodiment is:

$$\text{(number of spaces per lane for lane X)} = n \cdot 36 \cdot \text{(probability of rolling the lane number X with a single roll of a pair of dice)}$$

Where "n" is an integer value greater than zero. The preferred embodiment utilizes an "n" value of two which yields two positions 20 within lane 18 two, four positions 20 within lane 18 three, six positions 20 within lane 18 four, eight positions 20 within lane 18 five, 10 positions 20 within lane 18 six, 12 positions 20 within lane 18 seven, 10 positions 20 within lane 18 eight, eight positions 20 within lane 18 nine, six positions 20 within lane 18 10, four positions 20 within lane 18 11, and two positions 20 within lane 18 12, all of which are prior to said finish line 16. Alternative embodiments may utilize random number generators in place of said dice 34 which have a probability density function which differs from that of pair of dice. If so utilized, the number of positions or spaces 20 within each lane 18 must reflect the differing probability density function such that:

$$\text{(number of spaces per lane for lane X)} = n \cdot \text{(probability of generating the lane number X with a single event of the random number generator)}$$

Where "n" is an integer value greater than zero and of a value sufficient to assure the number of spaces or positions 20 for each lane 18 is an integer value. Alternative embodiments may further utilize dice 34 which have more or less than six sides, provided the aforesaid number of positions or spaces 20 per lane 18 is satisfied.

Although described as lanes 18, a starting gate 14, and a finish line 16, alternative embodiments may incorporate a plurality of directing means, starting positions, and finish positions which do not meet a strict definition of lanes, gates, and lines without departing from the scope and spirit of the present invention. These include but are not limited to colored areas or locations, player defined locations, or virtual positions implemented via computer software.

The game board 12 also has a holding stable 22 which is utilized for feeding the game 10 pot. That is, the holding stable 22 is filled with game pieces 30 which are not running or moving along the track 15 during game 10 play and are removed from specific lanes 18 prior to game 10 commencement. Instead, the game pieces 30 within the holding stable 22 are assigned a game currency 28 value which must be donated to the game 10 pot if a player rolls the value associated with the game piece 30 lane 18. For the preferred embodiment, a table space 24 is created within said holding stable 22 which allows each non-running game piece 30 to be placed at an intersection of a specific game currency 28 amount and an order of removal from the game 10. Since the game pieces 30 are preferably color coded and correspond with each lane 18 color for identification, if a player rolls a lane 18 value corresponding to a game piece 30 within the holding stable 22, the amount of the assigned game currency 28 value must be donated into the game 10 pot.

The preferred embodiment set of enumerated players cards 26 is shown in FIGS. 3A through 3K. Each card represents a numbered lane 18, with a preferred associated game piece 30, for the game 10 and a stake in the game 10 pot for the player(s) holding said card(s) 26. That is, each player is randomly dealt his/her share of said cards 26 from a shuffled deck at the beginning of the game 10. The game piece 30 which first crosses the finish line 16 is the winner of the game 10 and the game 10 pot is distributed to the players holding the cards 26 which represent the winning lane 18 in proportion to the cards 26 held by each player. As stated, the preferred embodiment utilizes four cards 26 per deck. Alternative embodiments may utilize one or a plurality of cards 26 for each lane 18 per deck or utilize cards 26 which are not enumerated and symbolically represent a particular lane 18 or may further assign lanes 18 to each player via manual or computer methods.

The fiat game currency 28 is shown in FIGS. 2A through 2E. A fixed amount of currency 28 is distributed to all the players prior to game play. The currency 28 is shown in denominations of one, two, three, five, and 10 for the preferred embodiment. Alternative embodiments may utilize game currency 28 of any shape, size, description, denomination, or virtually represent such via manual or computer methods. For the preferred embodiment of game 10 play, 75 units of said currency 28 is distributed to each player at the beginning of the game 10 with alternative embodiments allowing any amount of distribution prior to game 10 play.

The preferred embodiment game 10 instructions are illustrated in Figure four. For the preferred embodiment, each player is given 75 units of game currency 28 prior to game 10 play. The horse like shaped 32 game pieces 30 are positioned within each lane 18 which is assigned to the respective pieces 30. For the preferred embodiment, the game pieces 30 are color coded and match a color of the assigned lane 18. Alternative embodiments may utilize a plurality of methods for assigning game pieces 30 to a lane 18, including but not limited to numbering each game piece 30 or differentiating the shape or size of each game piece 30.

Pre-game preparation next removes one or more, preferably four, game pieces 30 from the game 10 and places them within the holding stable 22. For the preferred embodiment, four enumerated players cards 26 are dealt from a shuffled deck which represent the game pieces 30 which are removed from the game 10 and placed within the holding stable 22. Also for the preferred embodiment, the first game piece 30 removed is placed within the one dollar first square within the table space 24. Respectively, the second game piece 30 removed goes in the two dollar second square, the third game piece 30 removed goes in the three dollar third square, and the fourth game piece 30 removed goes in the four dollar fourth square. The preferred embodiment does not allow for duplicate game pieces 30 from the same lane 18 within the holding stable 22. Thus, if a duplicate lane 18 number is dealt from the deck prior to game 10 play, another card 26 is dealt until the holding stable 22 is filled. Alternative embodiments may fill the holding stable 22 in a plurality of ways, including but not limited to dice rolls 34, random selection, or player preference. The lane 18 numbers within the holding stable 22 represent the game pieces 30 (i.e. horse like shape 32) that are not within the game 10 (i.e. not running the race).

For the preferred embodiment, the remaining cards 26 are evenly dealt to the players until all cards 26 are dealt. A different starter person is designated during each round of card 26 dealing in order to ensure a fair distribution of the cards 26 prior to each round of the game 10. The initial starter can be chosen in any manner desired including but not limited to dice 34 rolls, oldest, youngest, etc. As described and depending upon the number of players, some players may end up with an additional card 26. Nevertheless, since the starter always changes, everyone will have an opportunity to have extra cards 26 throughout the duration of the game 10. Once dealt, the players examine their respective cards 26 and discard any numbers that are within the holding stable 22. The remaining cards 26 held by players are the game pieces 30 (i.e. horse like shapes 32) they have running in the race. For example, if the player holds 5, 9, and 11, those are the horse game pieces 30 he/she has running. A player may have more than one card 26 for any particular horse game piece 30 which provides a greater payout if the horse game piece 30 wins. For the preferred embodiment, all players ante one unit of game currency 28 into the game 10 pot and the game 10 begins.

The starter begins the race by rolling both dice 34. The value rolled will equal a horse game piece 30 in the race, or a horse game piece 30 within the holding stable 22. If the roll represents a game piece 30 in the race, that game piece 30 moves one position or space 20 within the corresponding numbered lane 18 towards the finish line 16. If the roll represents a game piece 30 within the holding stable 22, the roller must put the corresponding currency 28 amount in the game 10 pot. The next person (preferably clockwise from the starter) makes the next roll and repeats the aforesaid. The first game piece 30 past the finish line 16 wins. All players holding cards 26 corresponding to the winning game piece 30 lane 18 share in the game 10 pot in proportion to the number of cards 26 held. For the preferred embodiment, since there are four cards for every game piece 30, 25% of the game 10 pot is paid for each card 26 held. For example, if four different players hold the card 26 for the winning game piece 30 horse, they each get a fourth of the game 10 pot. If two players each hold two of the winning game piece 30 cards 26, they each get half the game 10 pot. If one player holds all four cards 26, that person gets the whole game 10 pot. Uneven amounts, rounded up to currency 28 units, are left in the game 10 pot. So if 10 currency 28 units were in the game 10 pot, and four different players held winning game piece 30 cards, each would get 2 units and 2 units would be left in the game 10 pot.

For the preferred embodiment, penalties are assessed as for each game piece 30 horse that does not leave the starting gate 14 (a sleeper horse). Each card 26 holder must put one currency 28 unit into the game 10 pot before the winners divide it for each card 26 held for each sleeper. If a die 34 rolls off the table, the die 34 rolling player pays five currency 28 units into the game 10 pot. Also, if a die 34 moves a game piece 30 from a position 20, that die 34 rolling player must pay five currency units into in the game 10 pot for each game piece 30 the die 34 moves.

The formal instructions for the preferred embodiment of the game 10 are quoted as follows:

Instructions 2-8 Players

Setting Up the Game

Give each player $75 of paper money.

Set up all horses at the proper starting gate (follow the colors)

Now you're going to take 4 horses out of the race and put them in the holding stable. You do this by dealing 4 cards face up. When each card is dealt, remove that horse from the starting gate and place it in the holding stable 1st horse goes in the 1 dollar 1st square 2nd horse goes in the 2 dollar 2nd square 3rd horse goes in the 3 dollar 3rd square 4th horse goes in the 4 dollar 4th square (See FIG. 4).

There can be no duplicates in the holding stable. If a card comes up that is already in the holding stable, put it on the duplicate card, then move on to the next card until you have four different numbers in the holding stable (example: 2, 4, 6, 8).

The numbers in the holding stable are the horses that are not running this race. Remove them from the starting gate (for the preceding example, horses 3, 5, 7, 9, 10, 11, and 12 are running. 2, 4, 6, and 8 are not, and are thus removed.)

Deal out the remaining cards to the players until they are gone, starting with a different player each round (this person is called "the starter"—after each race, the person clockwise from the starter becomes the new starter. The initial starter can be chosen any way you wish—dice, oldest, youngest, etc.)

Depending on the number of players, some players may end up with an additional card, but since the starter always changes, everyone will have an opportunity to have extra cards.

Everyone looks at their cards and discards any numbers that are in the holding stable.

The remaining cards held by players are the horses they have running in the race. For example, if the player holds 5, 9, and 11, those are the horses he or she has running. A player may have more than one card for any particular horse—this is fine, as the payout is then bigger (explained later.)

All players ante $1 into the pot.

The Race Begins

The Starter begins the race by rolling both dice. Either the number will equal a horse in the race, or a horse in the holding stable. If it's a horse in the race, that horse moves up one horseshoe on the track. If it's a horse in the holding stable, the roller must put the corresponding dollar amount in the pot.

Then the person clockwise from the starter makes the next roll (and moves a horse, or pays into the pot). And so on.

First horse past the finish line wins. All players holding cards for that horse get a share of the pot.

Payouts are as Follows:

Since there are four cards for every horse, 25% of the pot is paid for each card held. For example, if four different players hold the card winning horse, they each get a fourth of the pot. If two payers each hold two of the winning horse card, they each get half the pot. If one player holds all four cards, that lucky person gets the whole pot.

Uneven amounts, rounded up to dollars, are left in the pot. So if $10 were in the pot, and four different people held winning horse cards, each would get $2 and $2 would be left in the pot.

Penalties

For each horse that does not leave the starting gate (a sleeper horse), each card holder must put $1 into the pot before the winners divide it (and if you have multiple cards, you pay $1 for each.)

If a die rolls off the table, that player puts $5 into the pot.

If a die moves a horse off a horseshoe, that payer must put $5 in the pot for each horse the die moves.

Have fun playing and good luck!

The art of the present invention 10 may be adapted to a plurality of games and game styles and forms, including but not limited to computer animated or resident games.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A horse racing board game comprising:

a game board having a starting gate, a finish line, and eleven oval shaped lanes between said starting gate and said finish line; and eleven game pieces movable along said lanes from said starting gate to said finish line, each of said game pieces in the form of a horse and rider; and each of said lanes having a lane number from a two through a 12 and also having an amount of positions represented as horseshoes between said starting gate and said finish line; and a holding stable represented by a table space having a column printed with a specific game currency indicia of 1 dollar, 2 dollars, 3 dollars, and 4 dollars, and a row printed with an order of removal indicia of $1^{st}$, $2^{nd}$, $3^{rd}$, and $4^{th}$, within which four of said game pieces corresponding to four of said lanes are placed and removed from said lanes; and said holding stable centrally placed on said game board; and a game currency having the values of one, two, three, five, and 10; and a deck of enumerated players cards numbered said two through 12 corresponding to said lane numbers; and four non-duplicates of said enumerated players cards randomly selected from said deck representing four of said game pieces from said numbers of said lanes within said holding stable; and said amount of positions prior to said finish line for each of said lanes defined by an equation of n multiplied by 36 multiplied by a probability of a pair of dice rolling the lane number on a single roll where n is an integer value greater than zero; and said amount of positions prior to said finish line represented by two for said lane two, four for said lane three, six for said lane four, eight for said lane five, ten for said lane six, 12 for said lane seven, ten for said lane eight, eight for said lane nine, six for said lane 10, four for said lane 11, two for said lane 12.

2. The horse racing board game as set forth in claim 1, further comprising:

said holding stable located on said game board; and said table space within said holding stable having 16 spaces assigning said game currency value to the game pieces placed within said holding stable.

3. The horse racing board game as set forth in claim 2, further comprising:

said deck of enumerated players cards having four of each of said enumerated cards per said deck.

4. The horse racing board game as set forth in claim 3, whereby:

said pair of dice rolling the lane number allow a one position move of said game piece within said lane number toward said finish line; and said game piece within said lane number which reaches said finish line representing a distribution of a game pot pursuant to said enumerated players cards within a possession of one or more players; and said enumerated players cards having said lane numbers represented by said game pieces within said holding stable discarded without a payment by said players into said game pot.

5. The horse racing board game as set forth in claim 4, whereby:

said pair of dice rolling the lane number for said lane number represented within said holding stable requiring an amount of said game currency placement within said game pot corresponding to said intersection of a specific game currency value.

6. The horse racing board game as set forth in claim 5, whereby:

said lanes have a substantially oval form and said holding stable is located within said substantially oval form.

said game pieces within said lane numbers remaining at said starting gate upon one or more of said game pieces within said lane numbers reaching said finish line requiring placement of a penalty amount of currency into said game pot by one or more of said players having said possession of said enumerated players cards corresponding to said lanes remaining at said starting gate.

* * * * *